US008607887B2

(12) United States Patent
Kammer

(10) Patent No.: US 8,607,887 B2
(45) Date of Patent: Dec. 17, 2013

(54) CLOSURE FOR SPRINKLERS AND NOZZLES HAVING HEAT TRIPPING DEVICE

(76) Inventor: Peter Kammer, Derendingen (CH)

( * ) Notice: Subject to any disclaimer, the term of this patent is extended or adjusted under 35 U.S.C. 154(b) by 1183 days.

(21) Appl. No.: 12/306,157

(22) PCT Filed: Jun. 12, 2007

(86) PCT No.: PCT/IB2007/052208
§ 371 (c)(1),
(2), (4) Date: Apr. 24, 2009

(87) PCT Pub. No.: WO2008/004142
PCT Pub. Date: Jan. 10, 2008

(65) Prior Publication Data
US 2009/0301742 A1 Dec. 10, 2009

(30) Foreign Application Priority Data
Jul. 1, 2006 (CH) ..... 1064/06

(51) Int. Cl.
*A62C 37/12* (2006.01)

(52) U.S. Cl.
USPC ..... 169/57; 169/37; 169/38; 169/39; 169/40; 169/41; 169/56; 169/90

(58) Field of Classification Search
USPC ..... 169/57–63, 37–42, 56, 90; 239/37–42, 239/56, 57, 90, 288–288.5, 201, 208, 209
See application file for complete search history.

(56) References Cited

U.S. PATENT DOCUMENTS

| | | | | | |
|---|---|---|---|---|---|
| 3,727,695 | A | * | 4/1973 | Danton | 169/37 |
| 3,834,463 | A | * | 9/1974 | Allard et al. | 169/28 |
| 4,014,388 | A | * | 3/1977 | Anderson | 169/37 |
| 4,066,129 | A | * | 1/1978 | Anderson | 169/37 |
| 4,105,076 | A | * | 8/1978 | Simons et al. | 169/40 |
| 4,228,859 | A | * | 10/1980 | Hattori | 169/57 |

(Continued)

FOREIGN PATENT DOCUMENTS

| | | |
|---|---|---|
| DE | 49 669 C | 12/1888 |
| DE | 49669 C | 12/1889 |

(Continued)

OTHER PUBLICATIONS

International Search Report corres. to PCT/IB2007/052208—Completion Date: Sep. 26, 2007 by Marco Tempels, 2 pgs.

*Primary Examiner* — Jason J Boeckmann
*Assistant Examiner* — Joel Zhou
(74) *Attorney, Agent, or Firm* — Tarolli, Sundheim, Covell & Tummino LLP

(57) ABSTRACT

Disclosed is an intelligent, autonomously usable closure for misting nozzles, atomizing nozzles and sprinklers. A covering plate 20 is fixed on the closure having a heat tripping device, a nozzle body 2, outlet channel 11 and outlet opening 10 by means of a melt tripping device 5. The melt tripping device 5 is activated when necessary by a heat element 23 and the outlet opening 10 is released. A structural element 21, such as a disk spring, ensures at the melting moment of the melt tripping device 5 that a force F is applied and the covering plate 20 is separated with force from the outlet opening. In case of emergency, the release is triggered without energy. The proposed autonomous device can be used in a system network and can also be integrated into an existing system.

7 Claims, 3 Drawing Sheets

(56) References Cited

U.S. PATENT DOCUMENTS

| | | | | | |
|---|---|---|---|---|---|
| 4,618,002 | A | * | 10/1986 | Mears | 169/37 |
| 4,926,946 | A | * | 5/1990 | Polan | 169/37 |
| 5,020,601 | A | * | 6/1991 | Retzloff et al. | 169/37 |
| 5,117,916 | A | * | 6/1992 | Ohta et al. | 169/37 |
| 5,372,203 | A | * | 12/1994 | Galaszewski | 169/37 |
| 6,296,062 | B1 | * | 10/2001 | Sundholm | 169/37 |
| 6,484,809 | B1 | * | 11/2002 | Elder | 169/37 |
| 6,840,329 | B2 | * | 1/2005 | Kikuchi et al. | 169/37 |
| 6,896,066 | B2 | * | 5/2005 | Gil | 169/46 |
| 7,222,678 | B2 | * | 5/2007 | Shim | 169/37 |
| 7,314,094 | B2 | * | 1/2008 | Gow et al. | 169/38 |
| 7,543,654 | B2 | * | 6/2009 | Koiwa | 169/42 |
| 2005/0252665 | A1 | | 11/2005 | Kammer | |

FOREIGN PATENT DOCUMENTS

| | | | | | |
|---|---|---|---|---|---|
| DE | 162 309 | C | | 8/1905 | |
| DE | 162 309 | C | | 9/1905 | |
| GB | 200 971 | A | | 7/1923 | |
| GB | 200971 | | * | 7/1923 | A62C 37/11 |
| JP | 2000079182 | | * | 3/2000 | A62C 37/11 |
| WO | WO 98/31426 | A | | 7/1998 | |
| WO | WO03105963 | A1 | | 12/2003 | |

* cited by examiner

CLOSURE FOR SPRINKLERS AND NOZZLES HAVING HEAT TRIPPING DEVICE

CROSS-REFERENCES TO RELATED APPLICATIONS

This application claims priority from PCT International Application No. PCT/IB2007/052208, filed 12 Jun. 2007, which claims priority from Switzerland Application Serial No. 01064/06, filed 1 Jul. 2006. The present application claims priority to the aforementioned patent applications, which are incorporated in their entirety herein by reference for all purposes.

FIELD OF THE INVENTION

The present invention relates to a closure for sprinklers and nozzles comprising thermal tripping.

BACKGROUND OF THE INVENTION

A thermally reacting closure for sprinklers and nozzles is presented in patent application WO 03/105963 AI. The author describes in this invention a nozzle that is sealed at the end of the outlet channel by a cover plate. This cover plate is firmly connected to the nozzle body by a melt tripping device that acts as connection like soft solder. It is assumed in that invention that when the case arises the temperature in the space rises and the melt tripping device melts at a specific temperature and in this way releases the nozzle such that the extinguishing with the aid of extinguishant begins. Most sprinkler systems currently in use are based on the principle of an element installed in the sprinkler being directly heated as a consequence of the fire.

It has emerged in practice that the melting temperature of the melt tripping device can vary over the years. The temperature and fluctuations thereof in the monitored space, inter alia, play a role in this context. When the temperature rises above 30° C., it is possible for the material structure, and thus the property of the melt tripping device to vary slowly and in a creeping fashion. It is no longer possible to be sure whether the melt tripping device really does melt at the envisaged temperature. The melting point can be higher such that the response is too late, or else it can be lower such that the response is too early. Both promote damage that it is actually desired to avoid with the use of such devices.

Another problem of the invention presented in document WO 03/105963 A1 is the tripping room temperature. In principle, one would like to use the effect of the sprinklers and nozzles at the place of occurrence of blaze or fire. However, one is not sure whether the highest temperature occurs precisely where the fire or blaze would need to be extinguished. Sometimes, a local fire triggers too many sprinklers and/or nozzles, or the wrong ones, thus unnecessarily producing additional water damage.

In many cases, the beginning of a blaze cannot be detected by fire and the related development of heat, but can be detected by the development of smoke. Where there is smoke there is also certainly fire, but the high temperature governing and tripping the sprinkler occurs much later in some circumstances. This means that in many cases large amounts of damage have already occurred at the relatively late point in time at which the sprinklers and/or nozzles come into use.

For this reason, in most buildings fire alarms are installed that react to smoke, flames, temperature or a combination thereof, and trip an alarm that alarms the supervising staff before a fire breaks out. Thus, in addition to a sprinkler/nozzle system the buildings also further have an electric monitoring system.

SUMMARY OF THE INVENTION

The present invention now addresses the object of improving a closure for sprinklers and nozzles comprising thermal tripping of the type mentioned at the beginning in such a way that an alarm tripping apparatus firstly gives the alarm, but then automatically initiates an extinction function in the event of nonobservance of this alarm.

This object is achieved by a closure for sprinklers and nozzles comprising thermal tripping and having the features of patent claim 1. Further inventive features emerge from the dependent claims, and their advantages are explained in the following description.

The figures illustrate preferred exemplary design proposals that are explained as examples in the following description.

DESCRIPTION OF SPECIFIC

Preferred Embodiments of the Invention

The presented closure for sprinklers and nozzles comprising thermal tripping is used chiefly for misting nozzles, but can also be used mutatis mutandis for sprinklers.

The closure consists of a nozzle 1 comprising a nozzle body 2 that has an outlet opening 10 and an outlet channel 11 through which the extinguishant flows out at pressure and speed in the case of use. When the extinguishant is a liquid, it is broken up into droplets or jets as a function of pressure and speed through the outlet channel 11 and the outlet opening 10. The size of the droplets that are produced in nozzles, or the shape of the jets that are formed with sprinklers are dependent on pressure, speed and configuration of the outlet channel 11 and the outlet opening 10. What is decisive in this case is which extinguishant is selected, and the state in which this is intended to traverse the nozzle in the case of use. The shape of the outlet channel 11 and the outlet opening 10 is adapted to the pressure present in the system, and to the speed of the extinguishant that is desired for the extinction. The small droplets produced in a nozzle produce a spray mist that is distributed in 5 the entire volume of the sprayed space. With the shape of jets in which, for example, the extinguishant leaves a sprinkler, liquid is applied directly in the surroundings towards which the sprinkler is directed.

Figure 1:
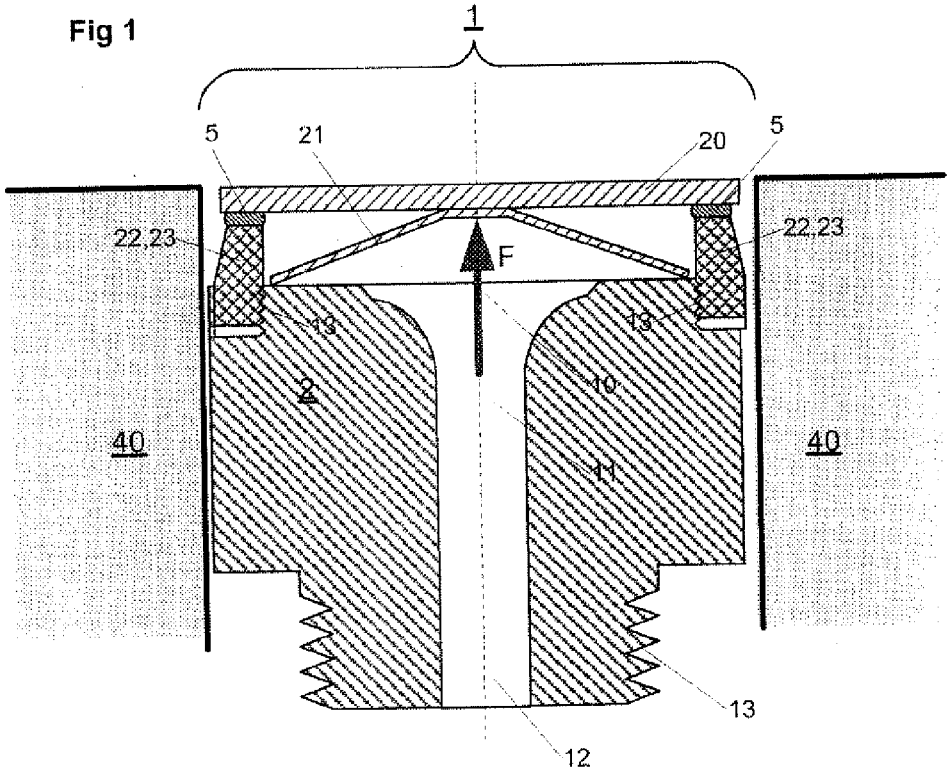
FIG. 1 shows a nozzle body with resistance heating coil.

As shown in FIG. 1, a cover plate is firmly connected via a ring 22 to the nozzle body 2 by a melt tripping device 5. The melt tripping device 5 can be a metal alloy, a plastic or an adhesive. The selected material must ensure the firm connection between ring 15 22 and cover plate against the force F over years. Furthermore, the material must have a relatively narrow melting range that can be reliably defined over years. The connection between cover plate and ring 22, which is ensured by the melt tripping device 5 is not intended to make any contact with the extinguishant if the same is a liquid. An instance of influence such as, for example, the cooling effect on the melt tripping device 5 occasioned by the application of extinguishant would change the melting range of said extinguishant. A structural part 21 has the effect of sealing off the nozzle and of keeping the extinguishant away from the melt tripping device 5. This structural part 21 under load simultaneously seals the outlet opening 10 and the outlet channel 11 on the nozzle body 2.

Figure 2:
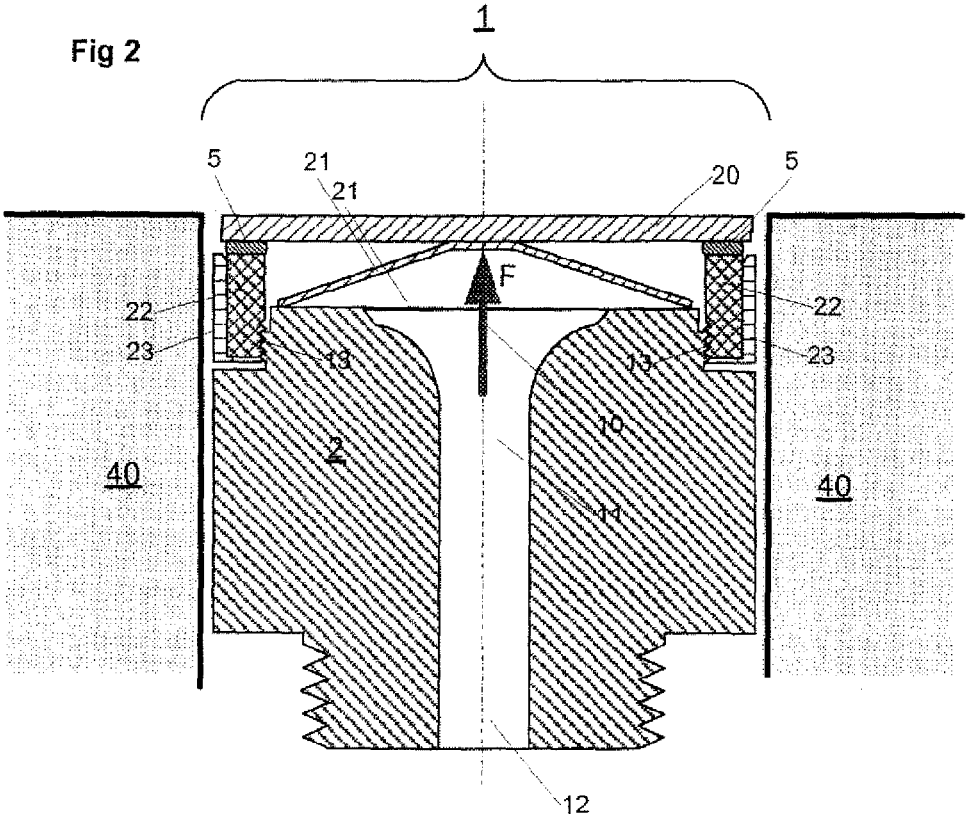
FIG. 2 shows a nozzle body with induction coil.

The ring 22 is, for example, screwed with the nozzle body 2. A heating element 23 can be integrated in the ring 22 (FIG. 1), or envelop the latter (FIG. 2). It is also possible for the ring 22 not to be a separate part but to be an annular elevation on the circumference of the nozzle body 2. structure is selected is decided by technique and the costs of fabrication. Which type of the production The heating element 23 can be in the form of a resistance heating means or of an induction heating means. What is important is that the heating power 5 thereof is sufficient for rapidly melting the melt tripping device 5 connecting the parts.

The structural part 21 is a spring element that is clamped under load between the nozzle body 2 and the 10 cover plate in the state of readiness. The melt tripping device 5 serving as connection must have sufficient connecting force to hold the force F produced by the structural part 21 over years. On the other hand, the force F must be so large that the 15 structural part 21 ensures a reliable sealing line together with the nozzle body 2 and, if it is an annular disk spring, with the cover plate 20.

As explained above, the loading of the structural part 21, and the force F must lie in a previously defined range. The limit values are: connecting force of the melt tripping device 5 as upper bound, and demand for leakproofness and reliable functioning in the individual case of use of the structural part 21 as minimum requirement placed on the force F. In order always to keep this force in a previously defined range during assembly, the ring 22 is connected to the cover plate with the aid of hot melt adhesive 5. The structural part 21 is then inserted into this unit 5, 20, 22. The whole is then connected to the nozzle body 2 via a thread 13 by means of a torque wrench in order to ensure the correct force F.

When the ring 22 is designed as an elevation of the nozzle body 2, the entire unit comprising ring 22 (which is part of nozzle body 2), structural part 21 would be inserted into an apparatus, the cover plate and ring 22 would be provided with hot melt adhesive 5 and be forced into the apparatus. In this state, the unit is heated to such an extent that the hot melt adhesive 5 melts and is connected to cover plate and ring 22. After the entire unit has been cooled or been 5 held together, the hot melt adhesive 5 keeps the unit together under the prescribed force.

The action tripped in the case of fire or necessity is not, as in conventional nozzles or sprinklers, produced 10 from outside by the known heat, but by targeted heating of the heating elements 23. This has the advantage, in turn, that the material that deforms under heat can also be installed in addition to the loaded structural part 21. The structural part 21 could be fabricated 15 from bimetal, for example. The minimum force required for sealing with which the structural part 21 must be clamped between cover plate and nozzle body 2 can be smaller. When the case. of use occurs, the loading of the structural part 21 is firstly increased by virtue of the fact that the bimetal deforms under heat. The melt tripping device then melts, so that the cover plate is separated from the ring 22 by considerable force and releases the path for the flow of the extinguishant via outlet channel 11 and outlet opening 10. In addition, tripping takes place in reality only when one of the sensitive control elements, or two thereof in combination, initiates the command therefor. This has the advantage that tripping takes place in reality only at the specific location and only at the correct time. If the control exerted by the electrically operated control instruments should fail, the melt tripping device melts nevertheless in the case of a breakdown as the last security measure at very high temperature.

The apparatus presented here is suitable for being used as an autonomous fire controller with thermostat 30, smoke sensor 31, intelligent element (chip) 32 and an energy source (battery) 33. Such elements can be applied relatively easily chiefly in the construction of offices, hotels and homes, and in cases where the installation of an entire setup and an entire system is 5 not justified. However, the apparatus also functions for gas extinguishing systems such as are used in computer rooms.

Such autonomous misting nozzles I can be grouped 10 together to form an overall system by connecting the intelligent elements (chips) 32 of the individual nozzles to one another. Thus, by way of example it is possible to install devices with thermostats wherever high temperatures are expected in the case of 15 damage. A smoke sensor can be installed if smoke is primarily expected, or the aim is to react to smoke. Multi-criteria sensors, for example, are installed in an environment that cannot be unambiguously assigned.

The intelligence of the system offers the possibility that an individual autonomous device firstly gives the alarm, and also only reacts in reality by using extinguishant after a defined time. Thus, for example, a fire detector gives the alarm when poisonous smoke endangers persons, doing so without immediately putting the entire extinguishing system into operation and thus initiating consequent damage. These intelligent systems serve as early warning systems for personal protection, while the conventional sprinkler systems with simple glass vessel tripping devices are suitable only for protecting buildings. The generally valid regulations above all prescribe reaction in the case of catastrophe. However, a point of the claims is that a warning is given long before the occurrence of the worst case, and intervention is possible. Such stepwise reacting systems react in a differential way to an appropriately envisaged case of occurrence, and permit expensive false alarms to fire and police services to be avoided.

Figure 3:
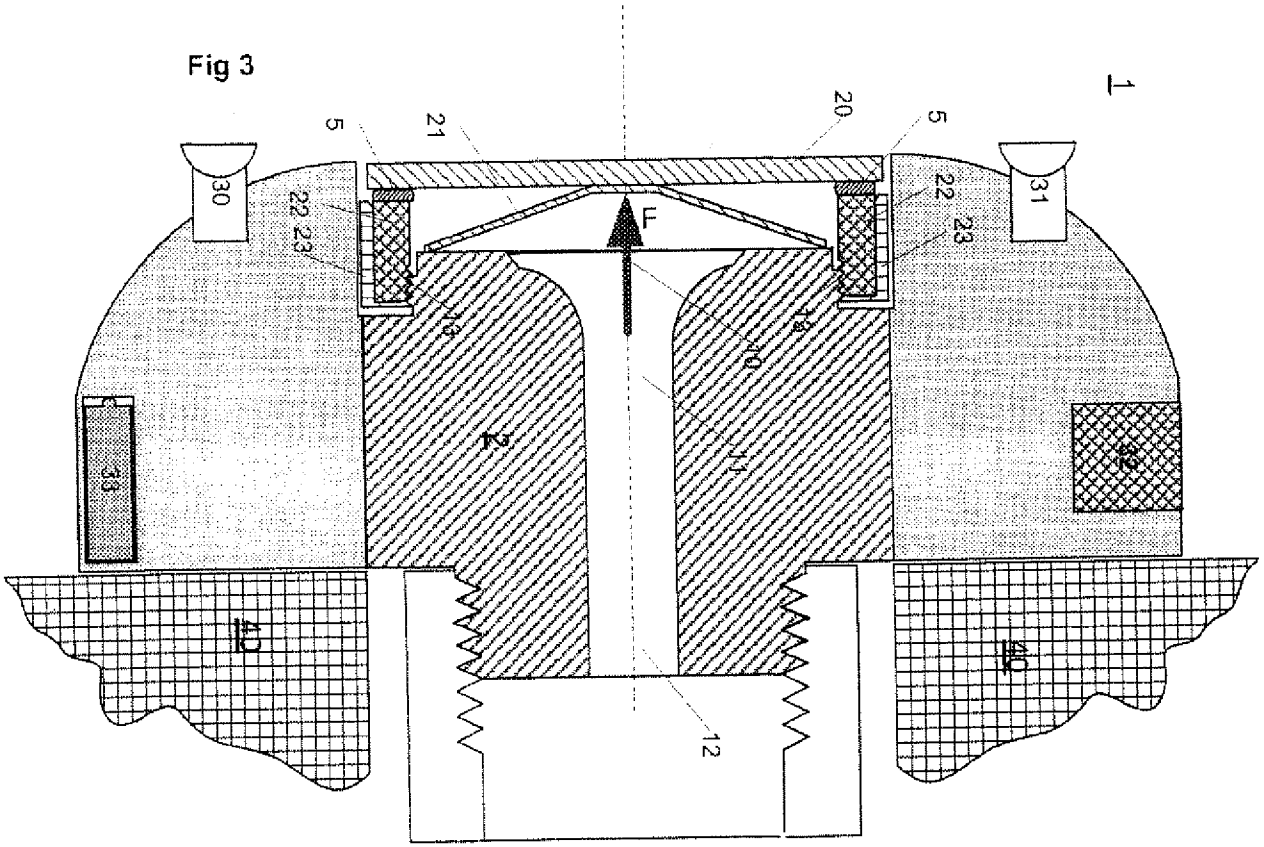
FIG. 3 shows a nozzle body with integrated control organs.

Solutions integrated in the ceiling 40 are illustrated 5 in FIG. 1 and FIG. 2. Of course, the cover plate can be a functional unit not only as in the case illustrated. It is also conceivable to incorporate it as a finished element in the room architecture, for example by having it as a round or arbitrarily shaped 10 flat element mounted on the ceiling 40. FIG. 3 illustrates a nozzle in the design of which an energy source 33, sensors 30, 31 and chip 32 are incorporated. Nozzle 1 and the ring 14 holding the intelligent elements 30, 31, 32, 33 are mounted on the ceiling 40. 15 In many cases, it can be desirable to shape the room such that no elevations can affect the configuration of a ceiling. It will be regarded as a measure known to the person skilled in the art, and therefore raises no problems, to install the entire unit in an opening in the ceiling, or even in the ceiling such that the presence of this firestop apparatus is not prominently in view.

The invention claimed is:

1. A closure for sprinklers and nozzles having a nozzle body with an outlet channel containing fluid extinguishant under pressure, said closure comprising:

a cover plate, a melt tripping device which connects said cover plate with the nozzle body prior to melting of said melt tripping device, and a spring element compressed against the nozzle body by said cover plate, said spring element having an inner side surface exposed to and urged toward said cover plate by fluid extinguishant under pressure prior to melting of said melt tripping device, said spring element having a peripheral edge portion which seals with said nozzle body to block flow of fluid extinguishant between said peripheral edge portion of said spring element and said nozzle body prior to melting of said melt tripping device, said peripheral edge portion of said spring element moves out of a sealing relationship with the nozzle body upon melting of said melt tripping device to facilitate a flow of extinguishant through the nozzle body.

2. The closure as claimed in claim 1 further including a ring which interconnects said melt tripping device and the nozzle body, said ring being connected to the nozzle body by mechanical means.

3. The closure as claimed in claim 1 wherein said spring element has an outer side surface which engages an inner side surface of said cover plate.

4. The closure element as claimed in claim 1 wherein said spring element is formed as a circular disk which is free of perforations which extend between inner and outer side surfaces of said circular disk.

5. The closure element as claimed in claim 1 wherein said spring element is formed as an annular disk.

6. The closure element as claimed in claim 1 wherein said spring element is formed of a bimetal which deforms under thermal influence.

7. The closure element as claimed in claim 1 further including a heating element disposed adjacent to said melt tripping device and is energizable to promote melting of at least a portion of said melt tripping device.

* * * * *